US010272929B2

(12) United States Patent
Swenson

(10) Patent No.: US 10,272,929 B2
(45) Date of Patent: Apr. 30, 2019

(54) SYSTEM AND APPARATUS TO MAINTAIN MINIMUM CLEARANCE BETWEEN TRAIN AND RAILWAY INFRASTRUCTURE

(71) Applicant: Progress Rail Locomotive Inc., LaGrange, IL (US)

(72) Inventor: Scott Swenson, Willowbrook, IL (US)

(73) Assignee: Progress Rail Locomotive Inc., LaGrange, IL (US)

( * ) Notice: Subject to any disclaimer, the term of this patent is extended or adjusted under 35 U.S.C. 154(b) by 256 days.

(21) Appl. No.: 15/152,240

(22) Filed: May 11, 2016

(65) Prior Publication Data

US 2017/0327136 A1 Nov. 16, 2017

(51) Int. Cl.

| | |
|---|---|
| ***B61F 19/04*** | (2006.01) |
| ***B61D 49/00*** | (2006.01) |
| ***B61K 13/00*** | (2006.01) |

(52) U.S. Cl.

CPC ..... *B61F 19/04* (2013.01); *B61D 49/00* (2013.01); *B61K 13/00* (2013.01)

(58) Field of Classification Search

CPC ..... E21B 17/1014; E21B 2023/008; E21B 47/00; F16L 2101/30; F16L 55/26; G01M 3/005; B08B 9/049; B61B 13/10; B65G 13/065; B65G 7/04; B61D 49/00; B61F 19/04

USPC .... 104/249, 245, 254, 257, 258, 259, 138.1, 104/138.2

See application file for complete search history.

(56) References Cited

U.S. PATENT DOCUMENTS

| | | | | |
|---|---|---|---|---|
| 1,164,467 | A | 12/1915 | Chaloner | |
| 4,557,327 | A * | 12/1985 | Kinley | E21B 17/1021 166/172 |
| 4,615,386 | A * | 10/1986 | Briscoe | E21B 17/1021 166/241.5 |
| 8,100,444 | B2 | 1/2012 | Erzgaber et al. | |
| 2004/0134373 | A1 | 7/2004 | Guenther et al. | |
| 2004/0244633 | A1 | 12/2004 | Witmer | |
| 2008/0236438 | A1 | 10/2008 | Herzog et al. | |
| 2009/0320713 | A1* | 12/2009 | Amiri | B61B 13/00 104/281 |
| 2014/0026781 | A1 | 1/2014 | Forbes et al. | |
| 2014/0165870 | A1* | 6/2014 | Bichler | E03F 3/06 104/138.2 |

FOREIGN PATENT DOCUMENTS

| | | |
|---|---|---|
| CA | 2 362 280 | 8/2000 |
| CN | 102607477 A | 7/2012 |
| CN | 102673586 A | 9/2012 |
| CN | 102765394 | 11/2012 |

(Continued)

*Primary Examiner* — Mark T Le

(74) *Attorney, Agent, or Firm* — Oblon, McClelland, Maier & Neustadt

(57) ABSTRACT

A system for maintaining a minimum clearance between a locomotive and a railway infrastructure is provided. The system includes at least one rollable and compressible device configured to be affixed or otherwise provided on a side of a locomotive or portion of a train. Each rollable and compressible device includes bi-directional rolling element and is configured to allow movement of the roller between a non-rolling state and a rolling state and between an uncompressed state and a predetermined maximum compressed state.

20 Claims, 10 Drawing Sheets

(56) References Cited

FOREIGN PATENT DOCUMENTS

| | | | |
|---|---|---|---|
| CN | 203528321 | U | 4/2014 |
| GB | 143169 | | 5/1920 |
| JP | 2007-231527 | A | 9/2007 |
| KR | 10-2012-0077863 | A | 7/2012 |

* cited by examiner

SYSTEM AND APPARATUS TO MAINTAIN MINIMUM CLEARANCE BETWEEN TRAIN AND RAILWAY INFRASTRUCTURE

TECHNICAL FIELD

The present disclosure relates to a system, a method, and an apparatus to maintain a minimum clearance between a portion of a train and a railway infrastructure.

BACKGROUND

Railway routes generally include various railway infrastructures, such as tunnels and walls. Such railway infrastructures can have close clearances with respect to train (i.e., distance between train or portion thereof and infrastructure) as the train passes the railway infrastructures. In some cases, speed restrictions are placed on the train passing the railway infrastructure. Further, laws and regulations may also place restrictions for operating the train through the railway infrastructure. Such laws and regulations require minimum clearances that must be respected from a closest point on the train to the railway infrastructure. For instance, a minimum clearance, such as 120 mm or 5 inches, may be mandated or required under certain laws or regulations.

Inputs from a railway track caused, for instance, by settling of the track can cause a top of the train to sway/roll or move in an unexpected direction affecting an expected dynamic motion of the train. In some instances, the inputs from the track can cause the train to move closer to the railway infrastructure than the minimum clearance, causing the train to touch the railway infrastructure.

Great Britain Patent No. 143169, hereinafter referred to as the '169 patent, describes a track apparatus for stopping trains. The '169 patent involves, generally speaking, improvements in automatic train stops. According to the '169 patent, a rod, which can have a rubber bumper, can be operated to engage with a tunnel wall to brake the train.

SUMMARY OF THE DISCLOSURE

In one aspect or embodiment of the present disclosure, a system for maintaining a minimum clearance between a locomotive and a railway infrastructure is provided. The system includes a locomotive, a first rollable and compressible device affixed on a first side of a locomotive at three-quarters height or above of the locomotive, and a second rollable and compressible device affixed on a second side of a locomotive at three-quarters height or above of the locomotive. Each of the first and second rollable and compressible devices includes a base plate having a first side and a second side opposite the first side. The second sides of the first and second rollable and compressible device contact the first and second sides of the locomotive, respectively. The first and second rollable and compressible devices also include a first set of arms having a first arm and a second arm, and a second set of arms having a first arm and a second arm. Each of the first and second sets of arms has first ends rotatably connected together at a first axis and second ends rotatably connected to the base plate. The first and second rollable and compressible devices include a roller rotatably coupled at an axle thereof to the first ends of each of the first and second sets of arms. The roller is configured to be rotatable in a first direction responsive to a movement of the locomotive forward and in a second direction opposite the first direction responsive to a movement of the locomotive backward. The first and second rollable and compressible devices also include a set of four double-acting torsion springs fixed to the base plate and respective ones of the first and second arms of the first and second sets of arms. The set of four double-acting torsion springs are configured to bias the first and second arms of the first and second sets of arms and the roller outwardly relative to the base plate. Further, each of the first and second rollable and compressible devices is configured to allow movement of the roller between a non-rolling state and a rolling state and between an uncompressed state and a predetermined maximum compressed state.

In another aspect or embodiment of the present disclosure, an apparatus for maintaining at least a minimum clearance between a portion of a train and a railway infrastructure as the train moves along the railway infrastructure is provided. The apparatus includes a base connectable to the portion of the train and a biasing structure. The apparatus also includes a bi-directional rolling element including an axle connected to the biasing structure of the base and a body rotatable around an axis formed by the axle. The biasing structure is configured to present the bi-directional rolling element at a predetermined outermost position, to allow inward movement of the rolling element along a predefined path responsive to an external compressive force acting on the rolling element, such that the rolling element is prevented from moving past a predetermined innermost position defined by the biasing structure, and to cause outward movement of the rolling element along the predefined path to the predetermined outermost position responsive to removal of the external compressive force.

In yet another aspect or embodiment of the present disclosure, a method is provided. The method includes providing a base that is connectable to a portion of a locomotive, the base including a biasing structure. The method also includes providing a roller connected to the biasing structure that includes a rotatable body. The biasing structure is configured to allow movement inward of the roller responsive to an external force acting on the roller, such that the roller is prevented from moving past a first predetermined position defined by the biasing structure. The biasing structure is also configured to cause movement outward of the roller to a second predetermined position responsive to removal of the external force, such that the roller is prevented from moving past the second predetermined position defined by the biasing structure.

Other features and aspects of this disclosure will be apparent from the following description and the accompanying drawings.

DETAILED DESCRIPTION

The description set forth below in connection with the appended drawings is intended as a description of various embodiments of the described subject matter and is not necessarily intended to represent the only embodiment(s). In certain instances, the description includes specific details for the purpose of providing an understanding of the described subject matter. However, it will be apparent to those skilled in the art that embodiments may be practiced without these specific details. In some instances, well-known structures and components may be shown in block diagram form in order to avoid obscuring the concepts of the described subject matter. Wherever possible, the same reference numbers will be used throughout the drawings to refer to the same or the like parts. Wherever possible, corresponding or similar reference numbers will be used throughout the drawings to refer to the same or corresponding parts.

Any reference in the specification to "one embodiment" or "an embodiment" means that a particular feature, structure, characteristic, operation, or function described in connection with an embodiment is included in at least one embodiment. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments, and it is intended that embodiments of the described subject matter can and do cover modifications and variations of the described embodiments.

It must also be noted that, as used in the specification, appended claims and abstract, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the described subject matter to any particular orientation or configuration. Furthermore, terms such as "first," "second," "third," etc. merely identify one of a number of portions, components, points of reference, operations and/or functions as described herein, and likewise do not necessarily limit embodiments of the described subject matter to any particular configuration or orientation.

Generally speaking, embodiments of the described subject matter relate to maintaining a minimum clearance distance between railway infrastructure and a portion of a train, such as the locomotive or hood.

Figure 1:
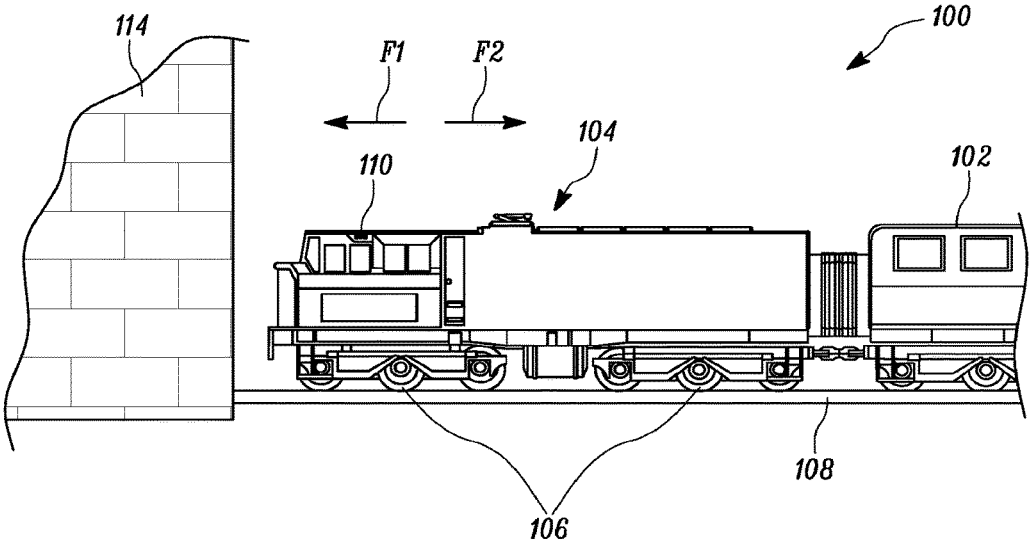
FIG. 1 is a side view of a train entering (or exiting) railway infrastructure in the form of a tunnel, according to one or more embodiments of the present disclosure.

FIG. 1 illustrates an exemplary train 100 moving in a forward direction "F1." Of course, the train 100 can also move in a backward direction "F2." The train 100 can include a locomotive 104 and one or more cars 102 coupled behind the locomotive 104 and one another. A portion of an example of a carriage car 102 is shown in FIG. 1. The locomotive 104 may include a power source (not shown), such as an engine, so that the locomotive 104 may pull and/or push the one or more cars 102. The engine may be mounted in an engine compartment (not shown) of the locomotive 104. Further, the car 102 may be mechanically coupled to the locomotive 104 through a mechanical coupling unit (not shown). The locomotive 104 also includes wheels 106 that are disposed to support and move the locomotive 104 on rails 108.

Further, the locomotive 104 can also include an operator cabin 110. For a semi-autonomous or a manually operated train, an operator can perform one or more operations of the train 100 from the operator cabin 110. The operator cabin 110 may include various control levers (not shown) and switches (not shown) to control operations of the locomotive 104. The locomotive 104 may also include a cooling hood 112 (shown in FIG. 4). The cooling hood 112 can receive and support cooling radiators (not shown) of the locomotive 104. The cooling hood 112 can be present at a rear end of the locomotive 104, for instance.

It may be contemplated that additional locomotives may be coupled to the locomotive 104, based on system requirements, without limiting the scope of the present disclosure. In such an example, the locomotive 104 and the additional locomotives may be co-operatively driven to move them in the forward direction "F1" and/or the backward direction "F2."

During movement of the locomotive 104 on the rails 108, the locomotive 104 may need to pass through railway infrastructure 114. The railway infrastructure 114 may include tunnels and walls, such as bridge walls, of varying dimensions. The railway infrastructure 114 may be hereinafter interchangeably referred to as "the railway wall 114," without any limitations. In the illustrated embodiment, the railway infrastructure 114 is embodied as a tunnel and corresponding inner wall and entrance portion thereof.

Figure 6:
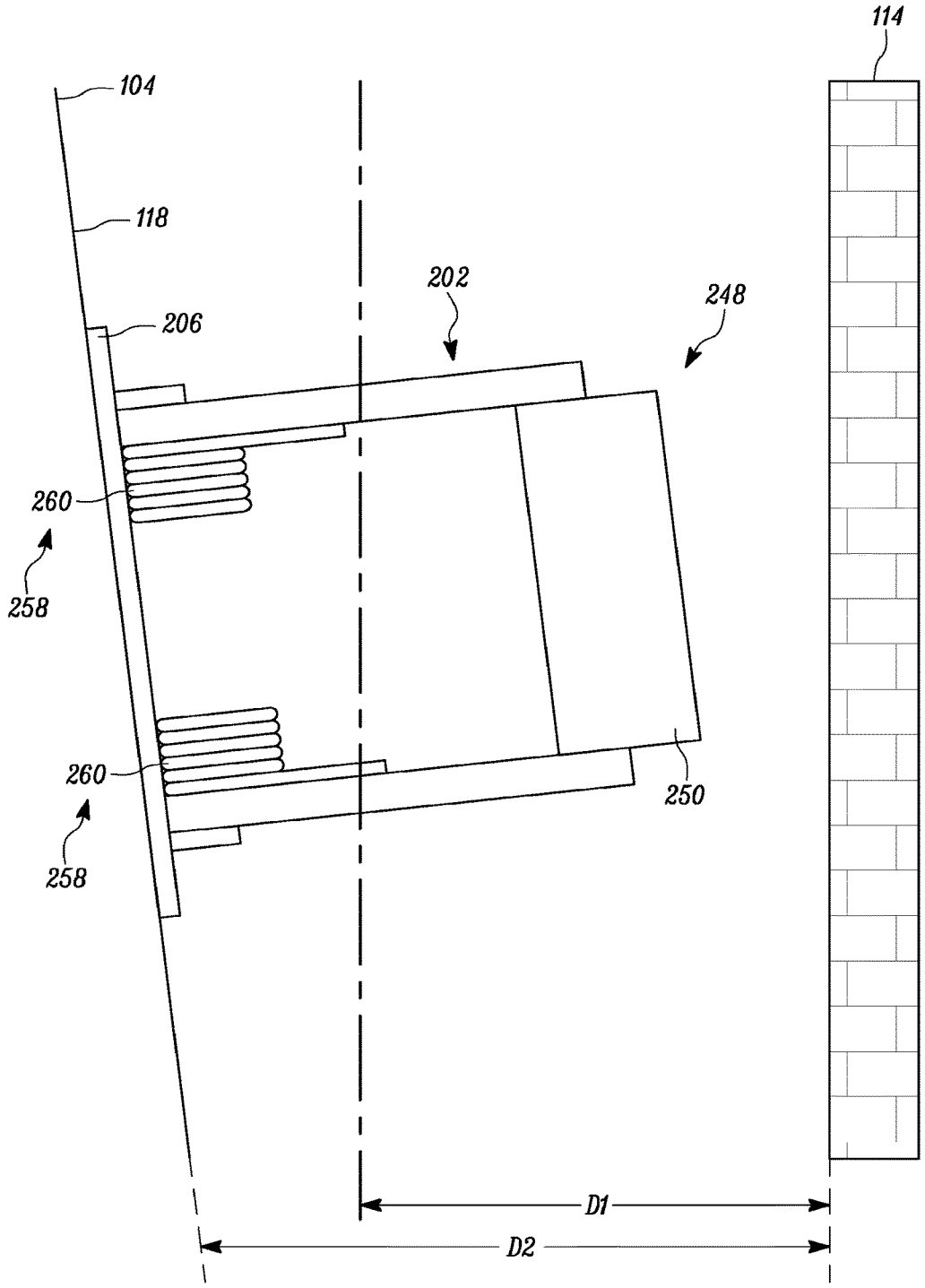
FIG. 6 is a side view of a rollable and compressible device in a non-rolling state and an uncompressed state, according to one or more embodiments of the present disclosure.
Figure 7:
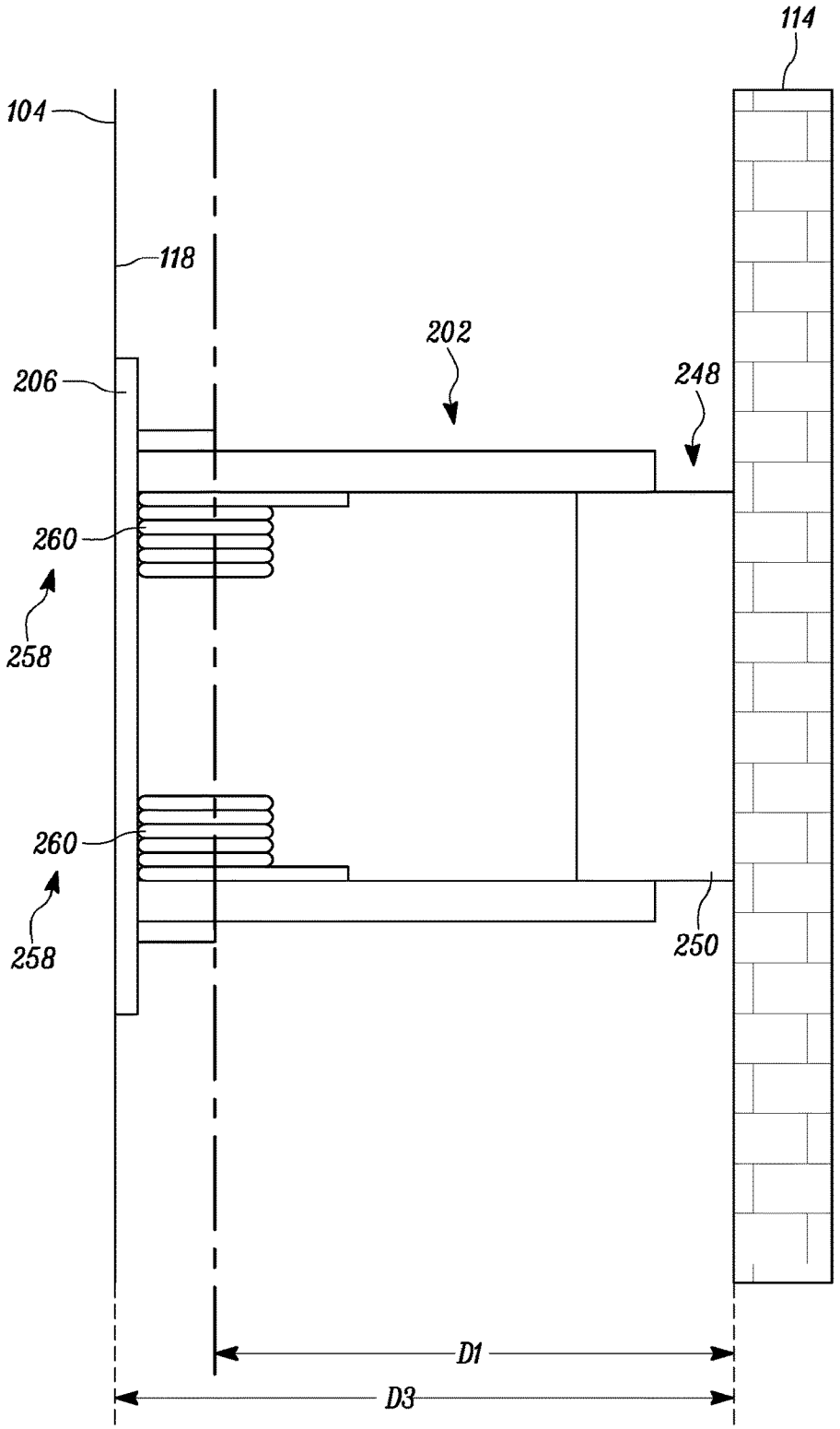
FIG. 7 is a side view of the rollable and compressible device of FIG. 6 in a rolling state and an uncompressed state, according to one or more embodiments of the present disclosure.
Figure 8:
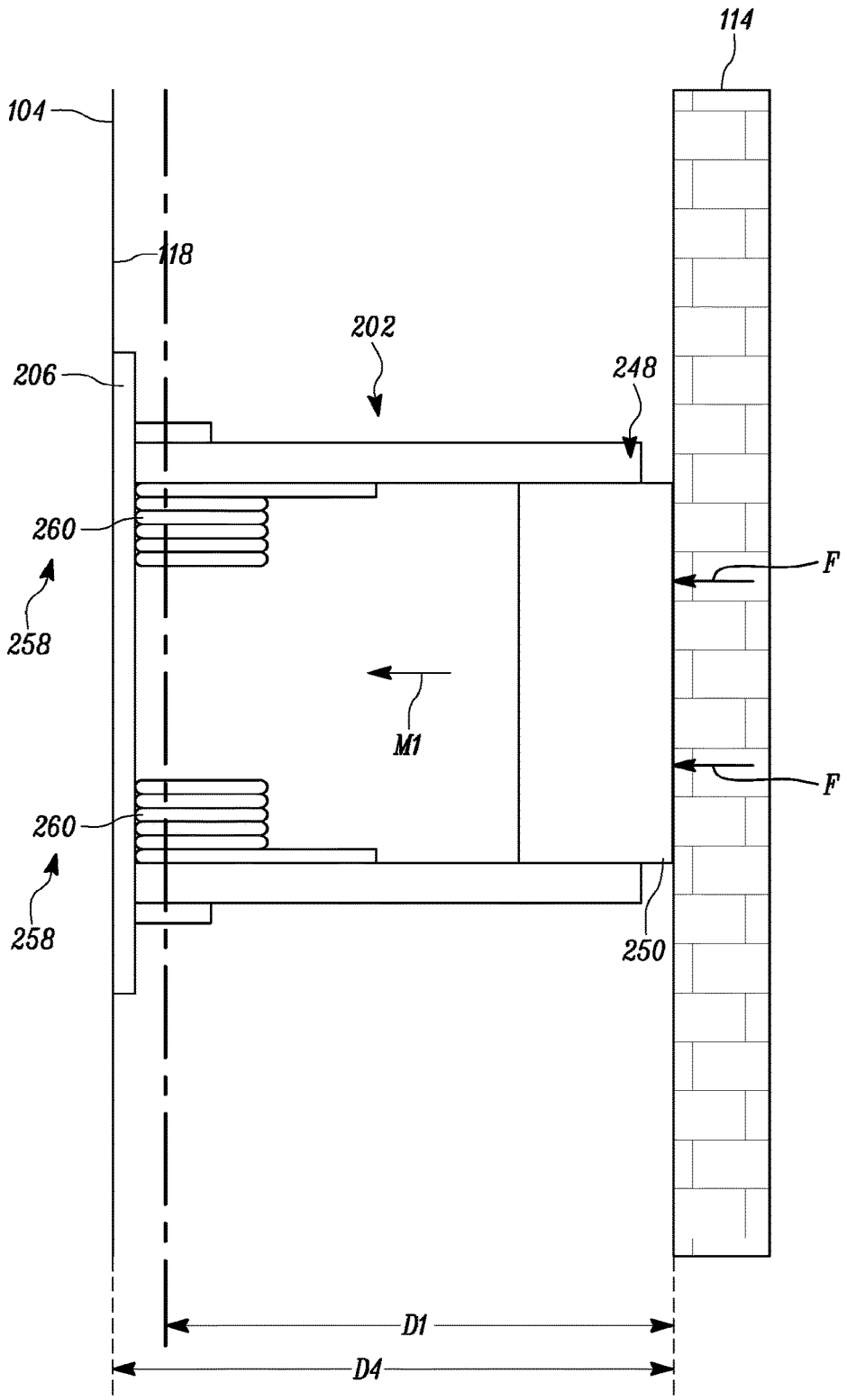
FIG. 8 is a side view of the rollable and compressible device of FIG. 6 in a rolling state and a compressed state, according to one or more embodiments of the present disclosure.

At some locations, the railway infrastructure 114 can have a relatively close clearance with respect to the locomotive 104 (i.e., the distance from the locomotive 104 and/or car 102 to the infrastructure) and it may be desirable or mandated that the locomotive 104 comes no closer to the infrastructure 114 than a minimum clearance "D1" (see, e.g., FIGS. 6-8). As noted above, embodiments of the disclosed subject matter involve and relate to systems (see, e.g., system 200 in FIG. 2), device(s) and methods for maintaining the minimum clearance "D1" between the locomotive 104 and the railway infrastructure 114. The minimum clearance "D1" may be hereinafter interchangeably referred to as "the minimum allowable distance D1" or "the predefined minimum distance D1," without any limitations.

Figure 2:
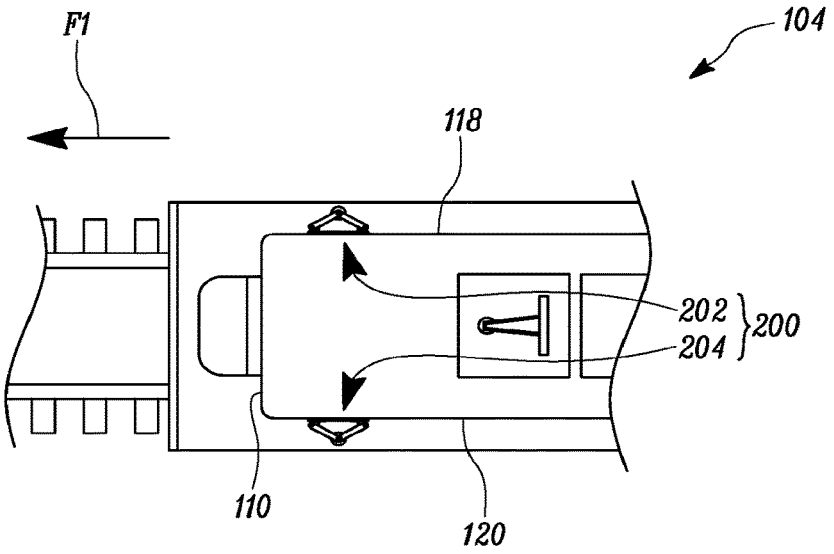
FIG. 2 is a top view of a locomotive of a train having a first rollable and compressible device and a second rollable and compressible device, according to one or more embodiments of the present disclosure.

Referring to FIG. 2, the system 200 can include a first apparatus 202 and a second apparatus 204 (of course, optionally, the system 200 can be defined by only one of the apparatuses 202, 204). The first apparatus 202 may be hereinafter interchangeably referred to as "the first device 202" or "the first rollable and compressible device 202." Further, the second apparatus 204 may be hereinafter interchangeably referred to as "the second device 204" or "the second rollable and compressible device 204."

The first and second rollable and compressible devices 202, 204 are configured to maintain the minimum clearance "D1" between the locomotive 104 on which they are provided and the railway infrastructure 114, as the locomotive 104 moves to and along the railway infrastructure 114. The first and second rollable and compressible devices 202, 204 can be provided at a relatively upper portion 116 of the locomotive 104, for instance, at three-quarters height or above of the locomotive 104, since inputs from the rail 108 can cause the upper portion 116 of the locomotive 104 periodically move closer to the infrastructure. More particularly, the first and second rollable and compressible devices 202, 204 can be affixed at a height that is three-quarters height or above of an overall height of the locomotive 104. In one example, the first and second rollable and compressible devices 202, 204 can be mounted at a height that is greater than half of the overall height of the locomotive 104. The first and second rollable and compressible devices 202, 204 can face radially outward in a horizontal direction or radially outward in a horizontal and vertical direction.

In the accompanying figure, the first and second rollable and compressible devices 202, 204 are coupled, fixedly or removably, to the operator cabin 110 of the locomotive 104. The first rollable and compressible device 202 can be affixed to a first side 118 of the locomotive 104, and the second rollable and compressible device 204 can be affixed to a second side 120 of the locomotive 104. Optionally, the first and second rollable and comopressible devices 202, 204 may be symmetrically provided on opposite sides of the locomotive in an overhead view, such as illustrated in FIG. 2 and/or a front view.

Figure 3:
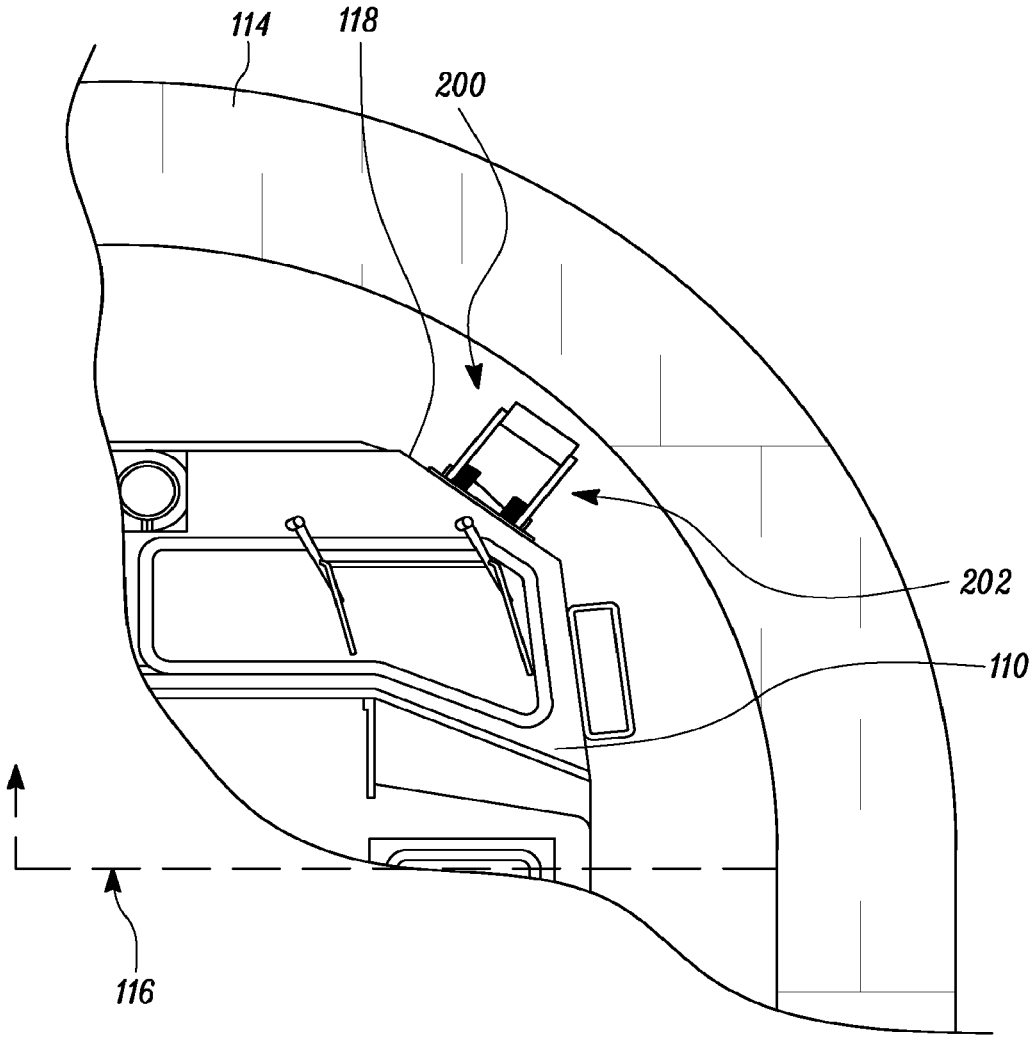
FIG. 3 is a front view of a portion of an operator cabin of a locomotive having the first rollable and compressible device provided thereon, according to one or more embodiments of the present disclosure.

FIG. 3 illustrates a front view of a portion of the operator cabin 110. As shown, the first rollable and compressible device 202 can be provided on the first side 118, of the upper portion 116 of the operator cabin 110 of the locomotive 104, such that the first rollable and compressible device 202 is proximal or adjacent to the railway infrastructure 114 as the locomotive 104 passes therethrough.

Figure 4:
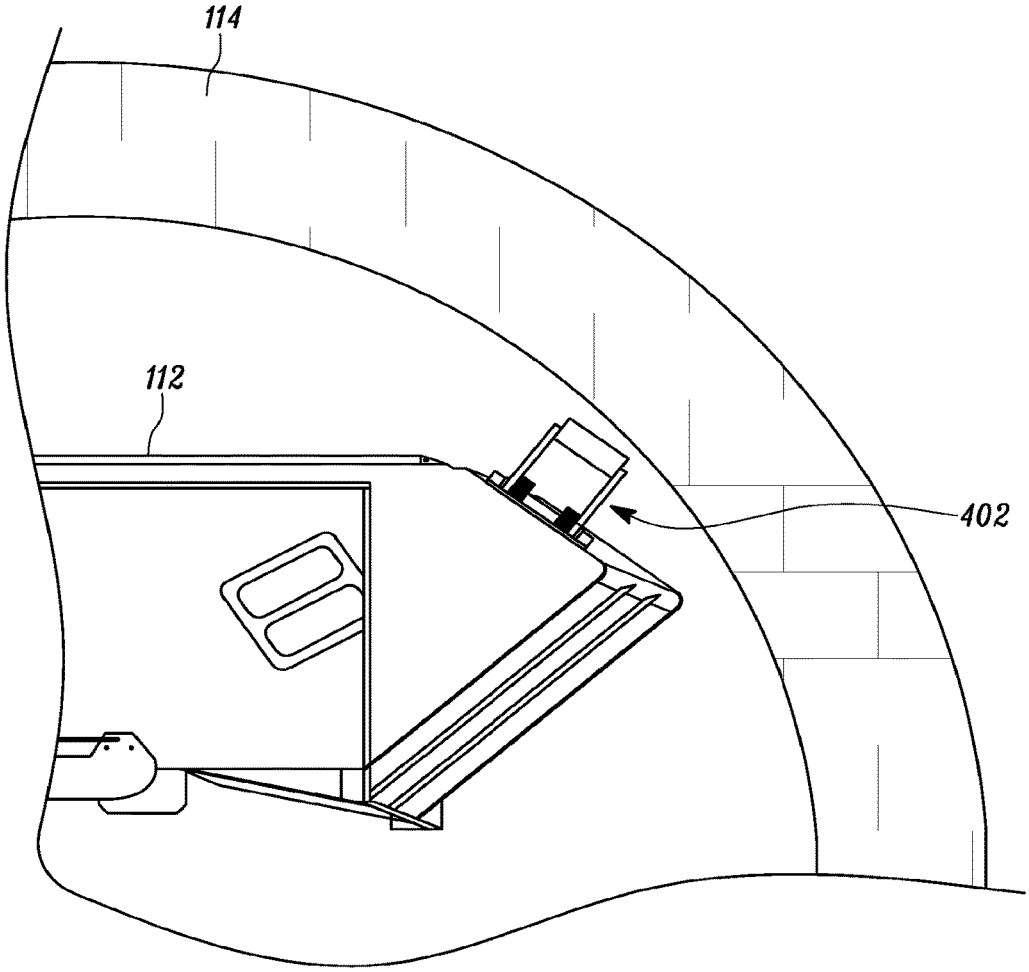
FIG. 4 is a perspective view of a cooling hood of the locomotive having a rollable and compressible device provided thereon according to one or more embodiments of the present disclosure.

As another example, rollable and compressible devices, such as the first rollable and compressible device 202, may be provided on a cooling hood 112 of the locomotive 104, such as illustrated in FIG. 4. Another rollable and compressible device (not shown) can also be affixed to the cooling hood 112 symmetrically opposite to the rollable and compressible device 402.

Generally, a rollable and compressible device according to one or more embodiments of the disclosed subject matter can be provided on a portion of the train (e.g., locomotive 104) at a portion known or anticipated to move and possibly breach the minimum clearance relative to various parts of railway infrastructure, such as an outermost part of the train or a portion of the train known or anticipated to move outward more than other portions. Also, it should be noted that more than two rollable and compressible devices may be associated with the locomotive 104, without limiting the scope of the present disclosure. For example, the system 200 may include multiple rollable and compressible devices mounted at various portions where the locomotive 104 is anticipated to contact the railway infrastructure 114. Also, the multiple rollable and compressible devices may be affixed to any portion of the train 100, without any limitations. For example, the rollable and compressible devices may be affixed to the carriage cars 102 or the additional locomotives of the train 100.

Certain characteristics of the first rollable and compressible device 202 will now be described in detail. However, it should be noted that some or all of the description provided below may be applicable to the second rollable and compressible device 204 shown in FIG. 2, the rollable and compressible device 402 shown in FIG. 4, a rollable and compressible device 902 shown in FIG. 9, and/or any other rollable and compressible devices according to embodiments of the disclosed subject matter, without limiting the scope of the present disclosure.

Figure 5:
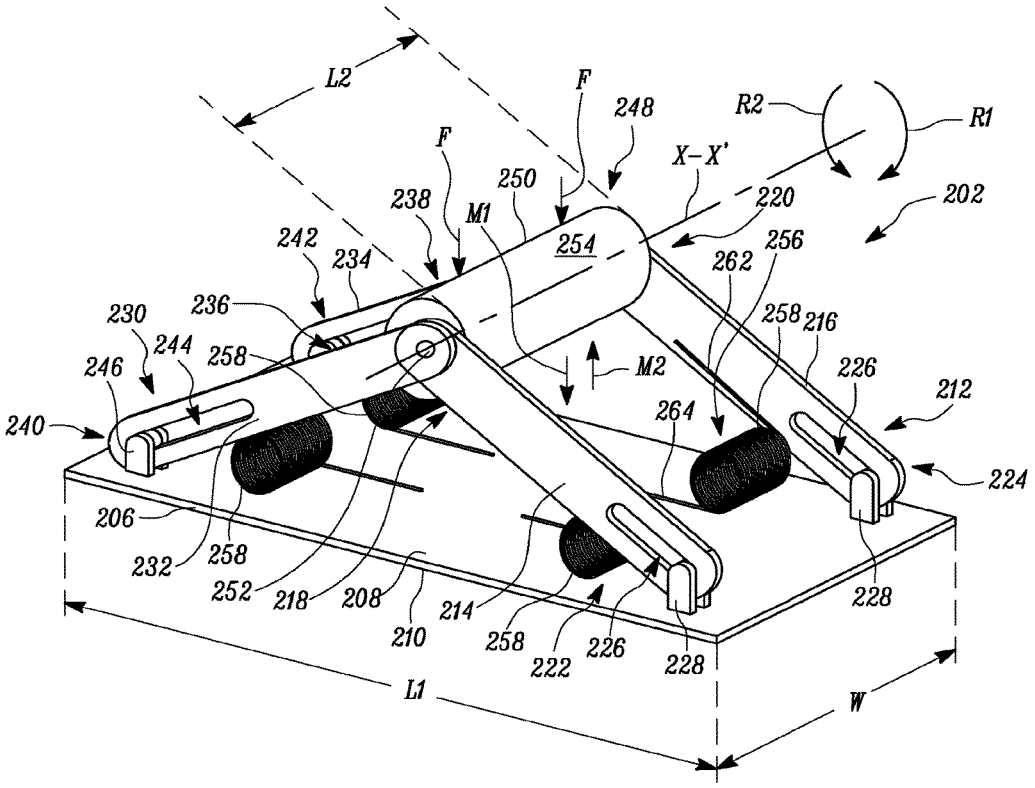
FIG. 5 is a perspective view of a rollable and compressible device according to one or more embodiments of the present disclosure.

FIG. 5 illustrates a perspective view of the first rollable and compressible device 202. The first rollable and compressible device 202 can include a base plate 206, which may be hereinafter interchangeably referred to as "the base 206," without any limitations. The base plate 206 has a first side 208 and a second side 210 opposite the first side 208. The first side 208 of the base plate 206 may be flat. The second side 210 of the base plate 206 is configured to be in contact with the first side 118 (see FIGS. 2 and 3) of the locomotive 104 when the first rollable and compressible device 202 is provided to the first side 118 of the locomotive 104 and may have a surface geometry that corresponds to a surface of the portion of the train to which it is provided.

The base plate 206 defines a length "L1" and a width "W." The length "L1" of the base plate 206 may be greater than the width "W" of the base plate 206. To affix the first rollable and compressible device 202 on the first side 118, in one example, the base plate 206 may be coupled to the first side 118 of the locomotive 104 by welding. In another example, the base plate 206 may be fastened to the first side 118 of the locomotive 104 using mechanical fasteners, such as screws, rivets, bolts, and pins. In yet another example, an adhesive may be used to couple the base plate 206 with the first side 118. Alternatively, any known coupling techniques may be employed to removably or permanently couple the base plate 206, and more particularly, the first rollable and compressible device 202 with the first side 118 of the locomotive 104.

The first rollable and compressible device 202 can also include a first set of arms 212, which can include a first arm 214 and a second arm 216. The first arm 214 includes a first end 218 and a second end 222. Similarly, the second arm 216 includes a first end 220 and a second end 224. The second ends 222, 224 of the first and second arms 214, 216, respectively, are coupled to the base plate 206. More particularly, the second ends 222, 224 of the first and second arms 214, 216, respectively, are rotatably coupled to the first side 208 of the base plate 206. The first and second arms 214, 216 include slots 226 that couple with brackets 228 in order to rotatably couple the first and second arms 214, 216 with the base plate 206. The first rollable and compressible device 202 can also include a second set of arms 230, which can include a first arm 232 and a second arm 234. The first arm 232 includes a first end 236 and a second end 240. Similarly, the second arm 234 includes a first end 238 and a second end 242. The second ends 240, 242 of the first and second arms 232, 234, respectively, are coupled to the base plate 206. More particularly, the second ends 240, 242 of the first and second arms 232, 234, respectively, are rotatably coupled to the first side 208 of the base plate 206. The first and second arms 232, 234 include slots 244 that couple with brackets 246 in order to rotatably couple the first and second arms 232, 234 with the base plate 206. Further, each of the first ends 218, 220, 236, 238 of the first arms 214, 232 and the second arms 216, 234 are rotatably connected together at a first axis X-X'. Of course, though the preceding description indicates arms 214 and 216 and arms 232 and 234 constitute respective pairs, arm 214 and arm 232 may constitute an arm pair and arm 216 and arm 234 may constitute an arm pair.

The first rollable and compressible device 202 can also include a rolling element 248, which may roll in one or both directions. The rolling element 248 can include a roller 250 and an axle 252. The roller 250 can include a rotatable body 254, which may be hereinafter interchangeably referred to as "the body 250." The roller 250 is rotatably coupled at the axle 252, which in turn is coupled to the first ends 218, 220, 236, 238 of each of the first arms 214, 232 and the second arms 216, 234. The roller 250 is rotatable around the first axis X-X' defined by the axle 252. The roller 250 is rotatable in a first direction "R1" responsive to a movement of the locomotive 104 in the forward direction "F1," and in a second direction "R2" opposite the first direction "R1" responsive to the backward direction "F2" of the locomotive 104. The roller 250 may move inwardly in a direction "M1" and outwardly in a direction "M2" depending upon whether or not an external force F is acting on the roller 250 and the amount of external force F acting on the roller 250 relative to the force exerted by the biasing structure 256.

The roller 250 can have a length "L2," which may be greater than half the width "W" of the base plate 206, in one or more embodiments. In the illustrated embodiment, the first rollable and compressible device 202 includes the single roller 250. However, it should be noted that the first rollable and compressible device 202 may include a number of distinct rollers, for instance, more than one per axle 252. In one embodiment, the first rollable and compressible device 202 can include a set of two or more independently rollable rollers, without limiting the scope of the present disclosure. Furthermore, optionally, the rollers can have different axles about which to rotate and may extend from the base plate 206 at same of different heights.

Dimensions, material, and surface properties of the roller 250 can be based on system requirements and may be changed based on the minimum clearance "D1" and/or the surface characteristics of the infrastructure. For instance, an outer diameter, material, or surface texture of the roller 250 can be changed based on a size of the locomotive 104, the minimum clearance "D1," and a surface texture or configuration of the railway infrastructure 114 expected to contact the roller 250. Further, the material of the roller 250 may be selected such that the material allows rolling and compression of the roller 250 against the railway infrastructure 114. For example, the roller 250 can be made of a durable material, such as a rubber. Alternatively, the roller 250 may be made from a plastic material, such as a polymer.

The first rollable and compressible device 202 can allow movement of the rolling element 248 between a non-rolling state and a rolling state. The rolling element 248 may be in the non-rolling state when the roller 250 is not in contact with the railway infrastructure 114, and the rolling element 248 may be in the rolling state when the roller 250 is in contact with the railway infrastructure 114 and the locomotive 104 is moving in the forward direction "F1" or the backward direction "F2."

The first rollable and compressible device 202 can also allow movement of the rolling element 248 between an uncompressed state, a compressed state, and a predetermined maximum compressed state. The rolling element 248 may be in the uncompressed state when no external compressive force acts on the rolling element 248, for instance, when the roller 250 is not in contact with the railway infrastructure 114. In some examples, the uncompressed state includes the rolling state of the rolling element 248.

Further, the rolling element 248 may be in the compressed state or the predetermined maximum compressed state when an external compressive force "F" (see, e.g., FIGS. 5, 8) acts on the rolling element 248 and the roller 250 is in contact with the railway infrastructure 114. The compressed state can be defined between the uncompressed state and the predetermined maximum compressed state. In an example, the minimum clearance "D1" between the locomotive 104 and the railway infrastructure 114 may be defined by the predetermined maximum compressed state. Also, the compressed state and the predetermined maximum compressed state can include the rolling state of the rolling element 248. The external compressive force "F" may be hereinafter interchangeably referred to as "the external force F," without any limitations.

It should be noted that the term "uncompressed state" may be hereinafter interchangeably referred to as "second predetermined position" or "predetermined outermost position," without limiting the scope of the present disclosure. Further, the term "predetermined maximum compressed state" may be hereinafter interchangeably referred to as "first predetermined position" or "predetermined innermost position," without limiting the scope of the present disclosure.

Referring again to FIG. 5, the first rollable and compressible device 202 can include a biasing structure 256. The biasing structure 256 can be coupled to the first and second sets of arms 212, 230 and the roller 250 and the axle 252 by way of the first and second sets of arms 212, 230. Generally speaking, the biasing structure 256 biases the rolling element 248 to the uncompressed state in a normal position of the first rollable and compressible device 202. Also, the biasing structure 256 controls movement of the rolling element 248, and more particularly the first rollable and compressible device 202, to move from and between the non-rolling and uncompressed state, the rolling and uncompressed state, the rolling and compressed state, and the rolling and predetermined maximum compressed state.

More particularly, the biasing structure 256 controls movement inward "M1" of the rolling element 248 along a predefined path responsive to the external compressive force "F" acting on the rolling element 248, such that the rolling element 248 is prevented from moving past the predetermined maximum compressed state that is defined by the biasing structure 256. The term "predefined path" referred to herein may be defined as a path along which the rolling element 248 moves in response to the application and removal of the external compressive force "F," and may be governed by the slots 226. In one example, the predefined path can be perpendicular or substantially perpendicular to the first axis X-X', when the external compressive force "F" is perpendicular to the first axis X-X'. Alternatively, the predefined path can make arc with respect to the first axis X-X', when the external compressive force "F" acts at an angle with respect to the first axis X-X'.

In one example, the biasing structure 256 controls movement of the rolling element 248 inward from the uncompressed state to a position between the uncompressed state and the predetermined maximum compressed state, based on the application of the external compressive force "F." The position between the uncompressed state and the predetermined maximum compressed state may correspond to the compressed state of the first rollable and compressible device 202. Further, the biasing structure 256 can control an outward movement "M2" of the rolling element 248 along the predefined path to the uncompressed state responsive to removal of the external compressive force "F." In an example, the biasing structure 256 controls movement outward of the rolling element 248 from the predetermined maximum compressed state to the uncompressed state, based on the removal of the external compressive force "F" and the counter forces created by one or more biasing elements of the biasing structure 256.

As an example of biasing elements, the biasing structure 256 can have a plurality of double acting springs 258, for instance, two sets. The sets of double-acting springs 258 can provide tension in the first rollable and compressible device 202 to maintain the rolling element 248 at the uncompressed state. In the illustrated example, the biasing structure 256 includes four double-acting torsion springs 258. A first end 262 of each of the set of double-acting springs 258 can be coupled to the base plate 206 and a second end 264 of each of the set of double-acting springs 258 can be coupled to the respective arms 214, 216, 232, 234 of the first and second sets of arms 212, 230. In one example, the sets of double-acting springs 258 can be coupled to the base plate 206 and the respective arms 214, 216, 232, 234 by welding, adhesives, or brazing, for instance.

The set of double-acting springs 258 biases the arms 214, 216, 232, 234 of the first and second sets of arms 212, 230 and the rolling element 248 outwardly relative to the base plate 206. It should be noted that characteristics and dimensions of the set of double-acting springs 258 may be chosen based on the minimum clearance "D1" required to be maintained between the locomotive 104 and the railway infrastructure 114, the diameter of the roller 250, forces anticipated to act on the rolling element 248, etc. Optionally, slots 226, 244 can be sized to work as a stop structure to restrict the movement of the rolling element 248 in the downward direction M1.

The first rollable and compressible device 202 can allow the rolling element 248 to move from and between the non-rolling and uncompressed state, the rolling and uncompressed state, the rolling and compressed state, and the rolling and predetermined maximum compressed state. For example, when the locomotive 104 enters the railway infrastructure 114 (see FIG. 1) and the roller 250 of the first rollable and compressible device 202 does not contact the railway infrastructure 114, the first rollable and compressible device 202 is in the non-rolling and uncompressed state. Of course, alternatively, the first rollable and compressible device 202 may contact the railway infrastructure upon entry and be in the rolling and uncompressed state. FIG. 6 illustrates the first rollable and compressible device 202 in the non-rolling and uncompressed state. As illustrated, the first rollable and compressible device 202 is in the non-rolling and uncompressed state, as the roller 250 is not in contact with the railway infrastructure 114, and no external compressive force acts on the rolling element 248. Of course, depending upon the axle and bearings of the first rollable and compressible device 202 the roller 250 may rotate slightly when not contacting the railway infrastructure and still be in a non-rolling state. Also, a distance "D2" defined between the locomotive 104 and the railway infrastructure 114 is greater than the minimum clearance "D1."

As alluded to above, the first rollable and compressible device 202 can roll along the railway infrastructure 114 when the locomotive 104 comes close to and contacts the railway infrastructure 114. FIG. 7 illustrates the first rollable and compressible device 202 in the rolling and uncompressed state, meaning that even though the rolling element 248 is contacting the railway infrastructure 114 (and the roller rolling 25), the biasing structure is not compressed or resists movement inward by the railway infrastructure 114. It should be noted that the rolling element 248 are in the rolling state due to contact of the roller 250 with the railway infrastructure 114, and the movement of the locomotive 104 in the forward direction "F1" or the backward direction "F2." Further, a distance "D3" defined between the locomotive 104 and the railway infrastructure 114 is greater than the minimum clearance "D1," indicating that the locomotive 104 is not in contact with the railway infrastructure 114 (and thus has not exceeded the minimum clearance distance D1). However, the distance "D3" defined between the locomotive 104 and the railway infrastructure 114 is less than the distance "D2" as the locomotive 104 is closer to the railway infrastructure 114.

If the locomotive 104 is caused to move toward the railway infrastructure 114, the first rollable and compressible device 202 can compress such that the locomotive 104 is prevented from exceeding the minimum clearance "D1" away from the railway infrastructure 114, and certainly not touching the railway infrastructure 114. FIG. 8 illustrates the first rollable and compressible device 202 in the rolling and compressed state (which may be a maximum compressed state depending upon the opposing forces created by a biasing structure 256). The first rollable and compressible device 202 may be in the rolling and compressed state when the roller 250 is in contact with the railway infrastructure 114, the locomotive 104 is moving in the forward direction "F1" or the backward direction "F2," and the external compressive force "F" is applied to the rolling element 248 by the railway infrastructure 114 in response to the contact. Further, a distance "D4" defined between the locomotive 104 and the railway infrastructure 114 is greater than the minimum clearance "D1." However, the distance "D4" defined between the locomotive 104 and the railway infrastructure 114 is less than the distance "D2" and the distance "D3" as the locomotive 104 is closer to the railway infrastructure 114.

It should be noted that when the locomotive 104 comes even closer to the railway infrastructure 114, the first rollable and compressible device 202 can compress, withstanding a force of the locomotive 104, until the first rollable and compressible device 202 is fully compressed to the minimum clearance "D1," required to be maintained, for instance, or even before the minimum clearance. In such a situation, the first rollable and compressible device 202 may be in the rolling and predetermined maximum compressed state. Further, in the rolling and predetermined maximum compressed state, a distance between the locomotive 104 and the railway infrastructure 114 may be equal to the minimum clearance "D1."

Figure 9:
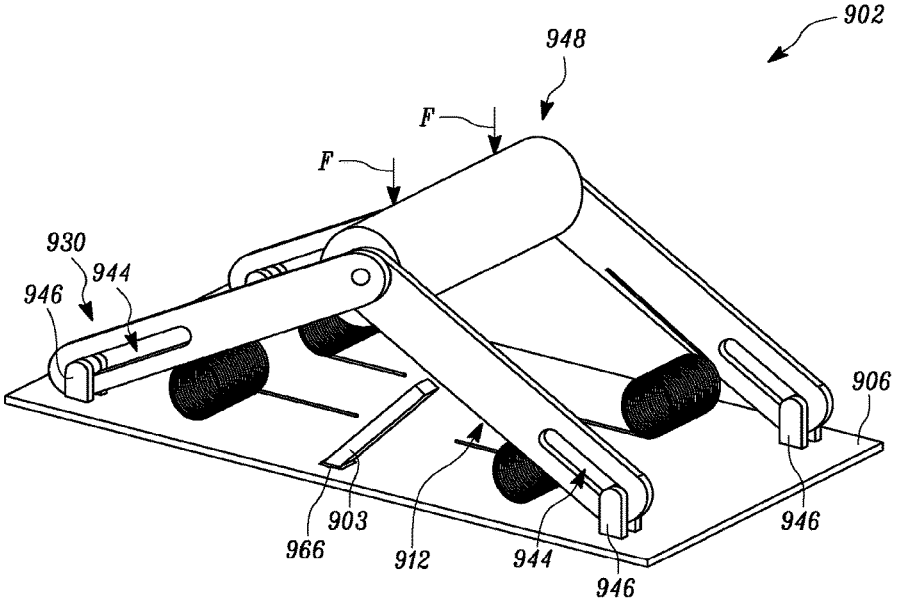
FIG. 9 is a perspective view of a rollable and compressible device having a stop structure, according to one or more embodiments of the present disclosure.

FIG. 9 illustrates a rollable and compressible device 902 according to another embodiment of the present disclosure. The rollable and compressible device 902 is similar to the first rollable and compressible device 202 except a hard stop structure is provided 903. The stop structure 903 can prevent a rolling element 948 from moving past the predetermined maximum compressed state created by the biasing structure alone. More particularly, when the external compressive force "F" acts on the rollable and compressible device 902, the stop structure 903 can prevent movement of the rolling element 948 beyond the predetermined maximum compressed state. That is, optionally, the stop structure 903 may define the predetermined maximum compressed state. Though FIG. 9 illustrates a single stop structure 903, in one or more embodiments multiple stop structures 903 may be provided, one for each arm, or one for each pair of arms.

Alternatively, the stop structure 903 may extend from one side of the base plate to the other side (in the width direction), so the rolling element and/or both sets of arms can be limited by the single stop structure 903.

For example, in FIG. 9, a first end 966 of the stop structure 903 is coupled to a base plate 906 of the rollable and compressible device 902. The stop structure 903 is coupled to the base plate 906 at a position that allows the stop structure 903 to restrict the movement of the rolling element 948 beyond the predetermined maximum compressed state. The stop structure 903 may be coupled to the base plate 906 by welding. Alternatively, mechanical fasteners or adhesives may be used to couple the stop structure 903 with the base plate 906. In yet another example, slots 944 provided in first and second sets of arms 912, 930 of the rollable and compressible device 902 can work as a stop structure to restrict the movement of the rolling element 948 in conjunction with the stop structure 903. More particularly, a size of the slots 944 in the first and second sets of arms 912, 930 can constitute the stop structure.

INDUSTRIAL APPLICABILITY

The present disclosure relates to devices, systems, and methods for maintaining a minimum clearance between a portion of a train (e.g., locomotive 104) and one or more railway infrastructures. The devices, systems and methods can maintain the minimum clearance from the railway infrastructure, for instance, to comply with laws and regulations. For explanatory purposes, this section will now explain aspects of the disclosed subject matter in reference to the first rollable and compressible device 202. However, it should be understood that some or all of the details given below may be applicable to other rollable and compressible devices 204, 402, 902, and systems and methods thereof without any limitations.

The first rollable and compressible device 202 can contact the railway infrastructure 114 so as to prevent the locomotive 104 or other portion of the train 100 from exceeding a minimum clearance "D1" to the railway infrastructure 114. Thus, the first rollable and compressible device 202 can prevent the locomotive 104 from contacting the railway infrastructure 114 during movement of the train 100 in the forward direction "F1" or the backward direction "F2." More particularly, the first rollable and compressible device 202 can prevent the locomotive 104 from exceeding the minimum clearance "D1," as the roller 250 can roll and be compressed in the first and second directions "R1," "R2" based on the movement of the locomotive 104 toward the infrastructure 114.

Further, the first rollable and compressible device 202 can be serviced without requiring removal of the first rollable and compressible device 202 from the locomotive 104. The first rollable and compressible device 202 can be adjusted i.e., components or settings of the first rollable and compressible device 202 may be set or reset based on the minimum clearance "D1" to be maintained between the locomotive 104 and the railway infrastructure 114 and/or the dimensions, characteristics and positioning of the rollable and compressible device or devices.

As noted above, the rollable and compressible devices according to various embodiments of the disclosed subject matter can be affixed at various locations on the train 100 at which contact with the railway infrastructure 114 is expected to first occur, such as the upper portion 116 of the locomotive 104 and/or an outermost or extreme portion of the locomotive 104. Further, the first rollable and compressible device 202 may be temporarily or permanently installed on the locomotive 104. Thus, in the case of temporary installation, the first rollable and compressible device 202 can be removed for maintenance or to re-configure for different operation parameters, such as a differently sized roller, roller of different material, double-acting springs of different strengths, and different stop points.

Figure 10:
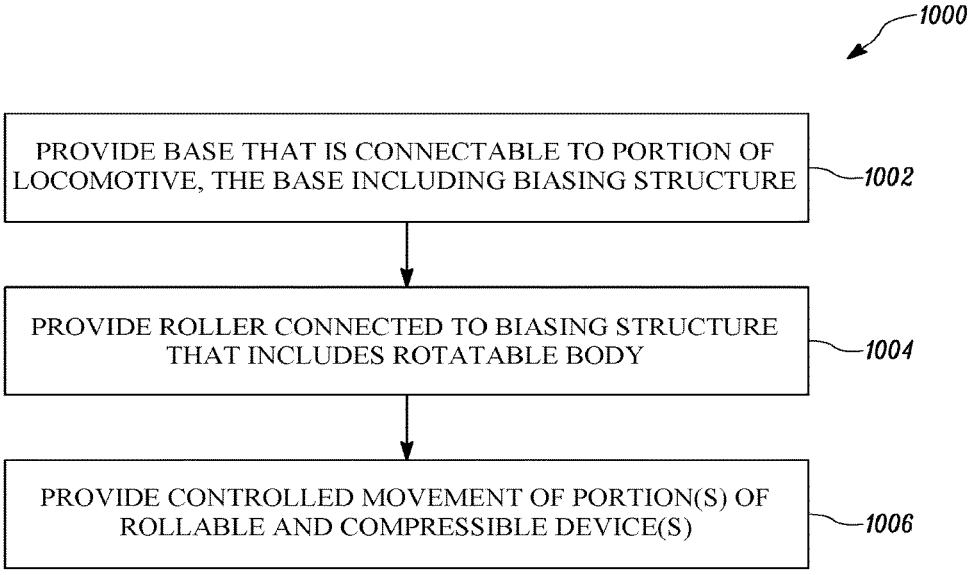
FIG. 10 is a flowchart of a method to maintain minimum clearance between a portion of a train and railway infrastructure, according to one or more embodiments of the present disclosure.

FIG. 10 illustrates a flowchart of a method 1000 of maintaining a minimum clearance "D1" between a portion of a train and railway infrastructure.

At step 1002, a base plate, such as a base plate 206 of a first rollable and compressible device 202, that is connectable to a portion of a train is provided. The base plate 206 includes a biasing structure, such as biasing structure 256.

At step 1004, a roller, such as roller 250 having the rotatable body 254 can be connected to the biasing structure 256, via first and second sets of arms 212, 230, for instance. The roller 250 can include the single rollable roller or a set of two independently rollable rollers. The first rollable and compressible device 202 is configured to compresses so as to prevent the train from exceeding the minimum clearance "D1" to the railway infrastructure 114 should the railway infrastructure 114 contact the roller 250. The minimum clearance "D1" may be defined by as a second predetermined position.

At step 1006, controlled movement of one or more rollable and compressible devices can be performed.

For example, a biasing structure, such as biasing structure 256, can allow the inward movement "M1" of the roller 250 responsive to an external force "F" or forces acting on the roller 250, but prevents the roller 250 from moving past a predetermined maximum compressed state defined by the biasing structure 256 and optionally, one or more static stops. Further, the biasing structure 256 can cause the outward movement "M2" of the roller 250, for instance, to a "less compressed state" or the uncompressed state responsive to the removal of the external force "F2," such that the roller 250 is prevented from moving past the uncompressed state defined by the biasing structure 256.

The biasing structure 256 can allow the roller 250 to move inward from the second predetermined position to the position between the second predetermined position and the first predetermined position, based on the application of the external force "F" caused by contact with the railway infrastructure 114. Also, the biasing structure 256 can allow the roller 250 to move inward from the second predetermined position to the first predetermined position, responsive to the external force "F." Further, the biasing structure 256 can cause the roller 250 to move outward to the second predetermined position.

The aforementioned controlled movement of the roller 250 inward and outward can be performed automatically without operator control, for instance, without any mechanical or electrical intervention by the operator and without any electrical intervention at all by an electronic controller or microprocessor.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A system for maintaining a minimum clearance between a locomotive and a railway infrastructure comprising:

a locomotive;

a first rollable and compressible device affixed on a first side of the locomotive, at three-quarters height or above of the locomotive; and a second rollable and compressible device affixed symmetrically opposite the first rollable and compressible device on a second side of the locomotive, at three-quarters height or above of the locomotive, wherein each of the first and second rollable and compressible devices includes:

a base plate having a first side and a second side opposite the first side contacting the first and second sides of the locomotive, respectively, a first set of arms having a first arm and a second arm;

a second set arms having a first arm and a second arm, each of the first and second sets of arms having first ends rotatably connected together at a first axis and second ends rotatably connected to the base plate, a roller rotatably coupled at an axle thereof to the first ends of each of the first and second sets of arms, the roller configured to be rotatable in a first direction responsive to a movement of the locomotive forward and in a second direction opposite the first direction responsive to a movement of the locomotive backward, and a set of four double-acting torsion springs fixed to the base plate and respective ones of the first and second arms of the first and second sets of arms, wherein the set of four double-acting torsion springs are configured to bias the first and second arms of the first and second sets of arms and the roller outwardly relative to the base plate, and wherein each of the first and second rollable and compressible devices is configured to allow movement of the roller between a non-rolling state and a rolling state and between an uncompressed state and a predetermined maximum compressed state.

2. The system of claim 1, wherein, for each of the first and second rollable and compressible devices, the base plate is welded to the first and second sides of the locomotive, respectively.

3. The system of claim 1, wherein, for each of the first and second rollable and compressible devices, the base plate is fastened to the first and second sides of the locomotive, respectively.

4. The system of claim 1, wherein the predetermined maximum compressed state includes the rolling state of the roller.

5. The system of claim 1, wherein the uncompressed state includes the rolling state of the roller.

6. The system of claim 1, wherein the predetermined maximum compressed state defines a minimum allowable distance between the locomotive and the railway infrastructure by which the locomotive passes.

7. The system of claim 1, wherein the roller has a length along the first axis greater than half a width of the base plate.

8. The system of claim 1, wherein the base plate has a length greater than a width of the base plate.

9. The system of claim 1, wherein the first side of the base plate is flat.

10. An apparatus for maintaining a minimum clearance between a locomotive and a railway infrastructure comprising:

a rollable and compressible device configured to be affixed on a side of the locomotive, at three-quarters height or above of the locomotive;

wherein the rollable and compressible device includes:

a base plate having a first side and a second side opposite the first side configured to be contacting the side of the locomotive, a first set of arms having a first arm and a second arm;

a second set arms having a first arm and a second arm, each of the first and second sets of arms having first ends rotatably connected together at a first axis and second ends rotatably connected to the base plate, a roller rotatably coupled at an axle thereof to the first ends of each of the first and second sets of arms, the roller configured to be rotatable in a first direction configured to be responsive to a movement of the locomotive forward and in a second direction opposite the first direction configured to be responsive to a movement of the locomotive backward, and a set of four double-acting torsion springs fixed to the base plate and respective ones of the first and second arms of the first and second sets of arms, wherein the set of four double-acting torsion springs are configured to bias the first and second arms of the first and second sets of arms and the roller outwardly relative to the base plate, and wherein the rollable and compressible device is configured to allow movement of the roller between a non-rolling state and a rolling state and between an uncompressed state and a predetermined maximum compressed state.

11. The apparatus claim 10, wherein, for the rollable and compressible device, the base plate is configured to be welded to the side of the locomotive.

12. The apparatus of claim 10, wherein, for the rollable and compressible device, the base plate is configured to be fastened to the side of the locomotive.

13. The apparatus of claim 10, wherein the predetermined maximum compressed state includes the rolling state of the roller.

14. The apparatus of claim 10, wherein the uncompressed state includes the rolling state of the roller.

15. The apparatus of claim 10, wherein the predetermined maximum compressed state defines a minimum allowable distance between the locomotive and the railway infrastructure by which the locomotive passes.

16. The apparatus of claim 10, wherein the roller has a length along the first axis greater than half a width of the base plate.

17. The apparatus of claim 10, wherein the base plate has a length greater than a width of the base plate.

18. The apparatus of claim 10, wherein the first side of the base plate is flat.

19. The apparatus of claim 10, wherein the base includes a stop structure to prevent the roller from moving past a predetermined innermost position along a predefined path defined by the rollable and compressible device.

20. The apparatus of claim 10, wherein the rollable and compressible device includes a plurality of distinct rollers rotatably coupled at the axle.

* * * * *